US009498685B2

(12) United States Patent
Abbott et al.

(10) Patent No.: US 9,498,685 B2
(45) **Date of Patent: *Nov. 22, 2016**

(54) PUTTER FACE INSERT

(71) Applicant: CALLAWAY GOLF COMPANY, Carlsbad, CA (US)

(72) Inventors: Craig E. Abbott, Vista, CA (US); Shane Parnell, Carlsbad, CA (US); Alan Hocknell, Encinitas, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/846,594

(22) Filed: Sep. 4, 2015

(65) Prior Publication Data

US 2015/0375069 A1 Dec. 31, 2015

Related U.S. Application Data

(63) Continuation-in-part of application No. 14/528,258, filed on Oct. 30, 2014, now Pat. No. 9,144,725, which is a continuation of application No. 14/205,991, filed on Mar. 12, 2014, now Pat. No. 8,915,798, which is a continuation of application No. 13/797,666, filed on Mar. 12, 2013, now Pat. No. 8,696,492, which is a continuation-in-part of application No. 13/445,757, filed on Apr. 12, 2012, now Pat. No. 8,684,860, which is a continuation-in-part of application No. 29/414,722, filed on Mar. 2, 2012, now Pat. No. Des. 672,418.

(60) Provisional application No. 61/609,737, filed on Mar. 12, 2012.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/04* (2013.01); *A63B 53/047* (2013.01); *A63B 53/0466* (2013.01); *A63B 53/0475* (2013.01); *A63B 2053/042* (2013.01); *A63B 2053/0408* (2013.01); *A63B 2053/0416* (2013.01); *A63B 2053/0425* (2013.01); *A63B 2053/0429* (2013.01); *A63B 2053/0445* (2013.01); *A63B 2053/0458* (2013.01); *A63B 2209/00* (2013.01); *A63B 2209/10* (2013.01)

(58) Field of Classification Search
CPC ..... A63B 53/0487; A63B 53/007; A63B 53/047; A63B 53/0475; A63B 2053/042; A63B 2053/0408; A63B 2053/0416; A63B 2053/0425; A63B 2053/0429; A63B 2209/00; A63B 53/04
USPC ..... 473/342, 329, 340, 348, 349
See application file for complete search history.

(56) References Cited

U.S. PATENT DOCUMENTS

| | | | | |
|---|---|---|---|---|
| 5,464,212 | A | 11/1995 | Cook | |
| 6,699,140 | B1 * | 3/2004 | Sun | A63B 53/0487 473/252 |
| 8,684,860 | B2 * | 4/2014 | Rollinson | A63B 53/007 473/329 |
| 9,005,052 | B1 | 4/2015 | Parnell | |
| 9,144,725 | B2 * | 9/2015 | Hocknell | A63B 53/04 |
| 2005/0119069 | A1 * | 6/2005 | Guard | A63B 53/0487 473/342 |

* cited by examiner

*Primary Examiner* — Benjamin Layno
(74) *Attorney, Agent, or Firm* — Rebecca Hanovice; Michael Catania; Sonia Lari

(57) ABSTRACT

A putter-type golf club head having a face insert composed of at least one thermoplastic polyether ester elastomer is disclosed herein. The face insert includes a plurality of oval-shaped holes having a specific size and spacing, and the at least one thermoplastic polyether ester elastomer incorporates polytetramethylene ether soft segments with molecular weights of greater than 1000 g/mol, preferably at least 1400 g/mol.

18 Claims, 5 Drawing Sheets

PUTTER FACE INSERT

CROSS REFERENCES TO RELATED APPLICATIONS

The present application is a continuation-in-part of U.S. patent application Ser. No. 14/528,258, filed on Oct. 30, 2014, and issued as U.S. Pat. No. 9,144,725 on Sep. 29, 2015, which is a continuation of U.S. patent application Ser. No. 14/205,991, filed on Mar. 12, 2014, and issued as U.S. Pat. No. 8,915,798 on Dec. 23, 2014, which is a continuation of U.S. patent application Ser. No. 13/797,666, filed on Mar. 12, 2013, and issued as U.S. Pat. No. 8,696,492 on Apr. 15, 2014, which is a continuation-in-part of U.S. patent application Ser. No. 13/445,757, filed on Apr. 12, 2012, and issued as U.S. Pat. No. 8,684,860 on Apr. 1, 2014, which is a continuation-in-part of and claims priority to U.S. Design patent application Ser. No. 29/414,722, filed on Mar. 2, 2012, which issued as U.S. Design Pat. No. D672,418 on Dec. 11, 2012, and also claims priority to U.S. Provisional Patent Application No. 61/609,737, filed on Mar. 12, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club face insert. More specifically, the present invention relates to a face insert for putter-type golf club heads having improved feel and performance qualities.

Description of the Related Art

The prior art discloses many different types of golf club heads, especially putter-type golf club heads. Although these inventions have disclosed various types of face inserts for said putter-type golf club heads, the prior art has not provided an optimized face insert that provides improved feedback and feel during putting combined with improved performance.

BRIEF SUMMARY OF THE INVENTION

The present invention provides a novel face insert that optimizes putter performance. For example, one aspect of the present invention is a golf club face insert comprising a front surface, a back surface, and a plurality of oval-shaped holes extending into the front surface, wherein each of the plurality of oval-shaped holes has a width of 0.150 inch to 0.200 inch and a height of 0.020 to 0.060 inch, and wherein the face insert is composed of at least one thermoplastic polyether ester elastomer. In some embodiments, the width may be approximately 0.180 inch and the height may be approximately 0.040 inch. In other embodiments, each of the plurality of oval-shaped holes may be spaced horizontally from neighboring oval-shaped holes by 0.01 to 0.03 inch and vertically from neighboring oval-shaped holes by 0.005 to 0.011 inch. In a further embodiment, each of the plurality of oval-shaped holes may be spaced horizontally from neighboring oval-shaped holes by approximately 0.026 inch and vertically from neighboring oval-shaped holes by approximately 0.009 inch. In another embodiment, the face insert may have a thickness of no less than 0.100 inch and no more than 0.300 inch, and at least one of the plurality of oval-shaped holes may extend completely through the face insert. In a further embodiment, the at least one thermoplastic polyether ester elastomer may incorporate polytetramethylene ether soft segments with a molecular weight of greater than 1000 g/mol.

Another aspect of the present invention is a golf club head comprising a body comprising a top surface, a bottom surface, a heel side, a toe side, and a face recess, and a face insert composed of a comprising a plurality of oval-shaped holes, wherein each of the plurality of oval-shaped holes has a width of 0.150 inch to 0.200 inch and a height of 0.020 to 0.060 inch, wherein the face insert is composed of at least one thermoplastic polyether ester elastomer, wherein the face insert is sized to fit within the face recess, and wherein the face insert is secured within the face recess. In a further embodiment, the golf club head may be selected from the group consisting of a fairway head, driver head, hybrid head, iron head, and putter head, and each of the plurality of oval-shaped holes may be spaced horizontally from neighboring oval-shaped holes by 0.01 to 0.03 inch and vertically from neighboring oval-shaped holes by 0.005 to 0.011 inch. In a further embodiment, each of the plurality of oval-shaped holes may be spaced horizontally from neighboring oval-shaped holes by approximately 0.026 inch and vertically from neighboring oval-shaped holes by approximately 0.009 inch. In another embodiment, the at least one thermoplastic polyether ester elastomer may incorporate polytetramethylene ether soft segments with a molecular weight of greater than 1000 g/mol.

Yet another aspect of the present invention is a putter head comprising a body comprising a top surface, a bottom surface, a heel side, a toe side, and a face recess, and a face insert composed of at least one thermoplastic polyether ester elastomer, wherein the at least one thermoplastic polyether ester elastomer incorporates polytetramethylene ether soft segments with a molecular weight of greater than 1000 g/mol, and wherein the face insert is disposed within the face recess. In some embodiments, the face insert may be permanently fixed within the face recess. In other embodiments, the face insert may comprise a plurality of oval-shaped holes, which may each be spaced horizontally from neighboring oval-shaped holes by 0.01 to 0.03 inch and vertically from neighboring oval-shaped holes by 0.005 to 0.011 inch. In a further embodiment, at least one of the plurality of oval-shaped holes may extend completely through the face insert. In some embodiments, the face insert may have a thickness of no less than 0.100 inch and no more than 0.300 inch, and in other embodiments, the polytetramethylene ether soft segments may have a molecular weight of at least 1400 g/mol.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to an improved face insert for use in golf club heads, particularly putters, though it may be used in connection with wood-type golf club heads like fairways, drivers, and hybrids, as well as with iron-type golf club heads.

Figure 1:
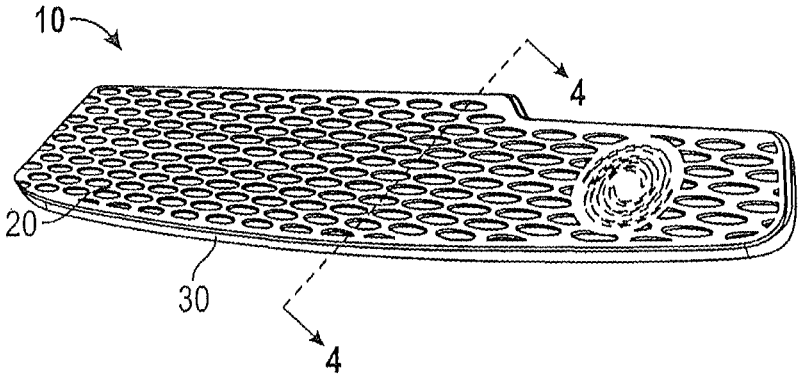
FIG. 1 is a front perspective view of a first embodiment of the present invention.
Figure 4:
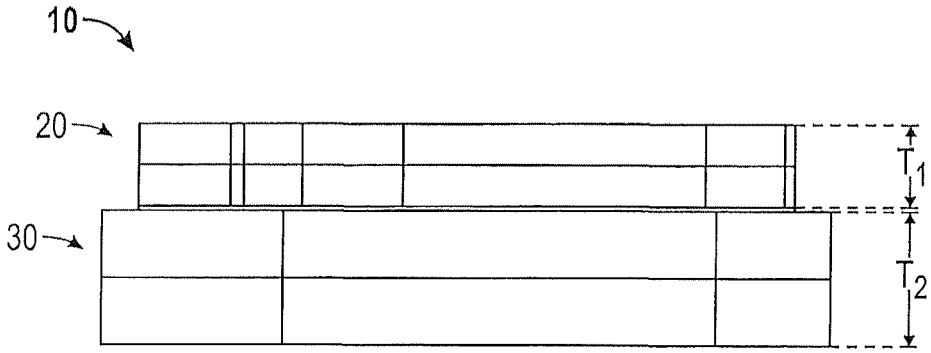
FIG. 4 is a cross-sectional of the embodiment shown in FIG. 1 along lines 4-4.

In a first embodiment, shown in FIGS. 1 and 4, the face insert 10 comprises a metal striking sheet 20, which is preferably composed of 6061 aluminum, and a polymeric backing 30, which is preferably composed of a urethane having a hardness of Shore 40D to 60D. The metal sheet 20, which is designed to make contact with and grip a golf ball, includes a textured surface 22 composed of a plurality of oval-shaped holes 24 that are stamped into the metal sheet 20, the edges of which are then machined to achieve sharpness. The holes 24 in this embodiment do not extend through the entire thickness $T_1$ of the metal sheet 20, but in an alternative embodiment, disclosed herein, they may do so. In alternative embodiments of the present invention, the striking sheet 20 may be made of any metal material that has similar properties to 6061 aluminum, or out of titanium, stainless steel, or a hard plastic, and the holes 24 may be machined into the sheet 20 instead of stamped. In these alternative embodiments, the holes 24 may have one or more different, geometric shapes.

Figure 2A:
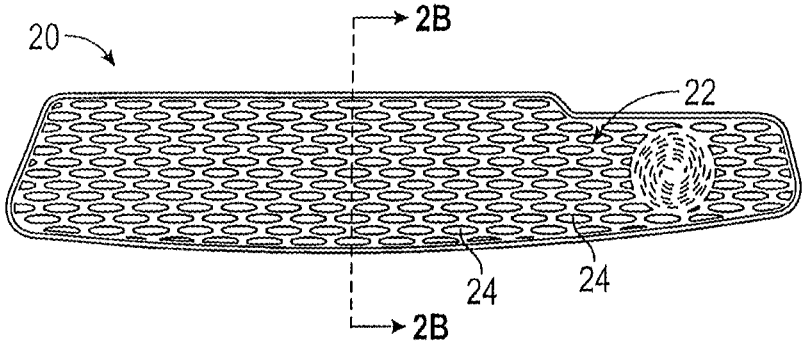
FIG. 2A is a front plan view of part of the embodiment shown in FIG. 1.
Figure 2B:
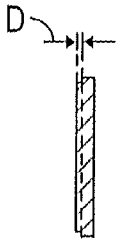
FIG. 2B is a cross-sectional view of the embodiment shown in FIG. 2A along lines 2B-2B.
Figure 2C:
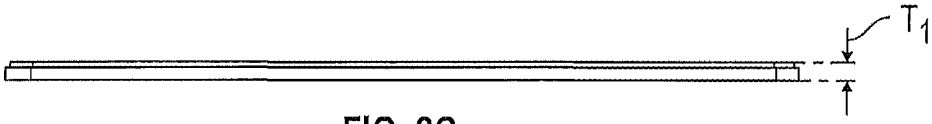
FIG. 2C is a bottom plan view of the embodiment shown in FIG. 2A.
Figure 3:
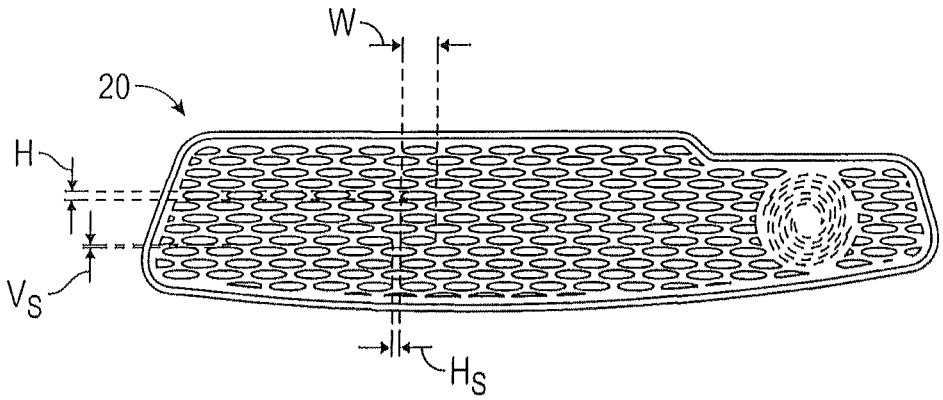
FIG. 3 is another front plan view of the part of the embodiment shown in FIG. 2A.

The specific dimensions of the metal sheet 20, including the holes 24, allow the face insert 10 to grip the surface of a golf ball. As shown in FIGS. 2B-3, in the preferred embodiment, the metal sheet 20 has a thickness $T_1$ of 0.050 inch to 0.100 inch, more preferably 0.075 inch, while the holes 24 have a depth D of 0.005 inch to 0.015 inch, more preferably 0.012 inch, a height H of 0.020 to 0.060 inch, more preferably 0.040 inch, and width W of 0.150 inch to 0.200 inch, more preferably 0.180 inch. To maximize the gripping effect, the holes 24 have vertical spacing Vs from each other of 0.005 to 0.011 inch, more preferably 0.009 inch, and horizontal spacing Hs of 0.01 to 0.03 inch, more preferably 0.026 inch.

While the metal sheet 20 makes contact with and grips the golf ball, the backing 30 absorbs the force of contact with a golf ball, allowing for the ball to make longer contact with the metal sheet 20 portion of the face insert 10 and providing desired performance characteristics. To maximize the absorption of the force of impact with a golf ball, the backing 30 preferably has a thickness $T_2$ of 0.100 to 0.150 inch, and more preferably a thickness of approximately 0.120 inch. Though the preferred embodiment of the backing 30 is composed of a urethane material having a hardness of Shore 60D, in alternative embodiments the backing may be composed of non-metal materials having similar performance characteristics. In some embodiments, the backing 30 may be composed of materials having a hardness of Shore 40D-55D, which yield slower ball speed.

Figure 5:
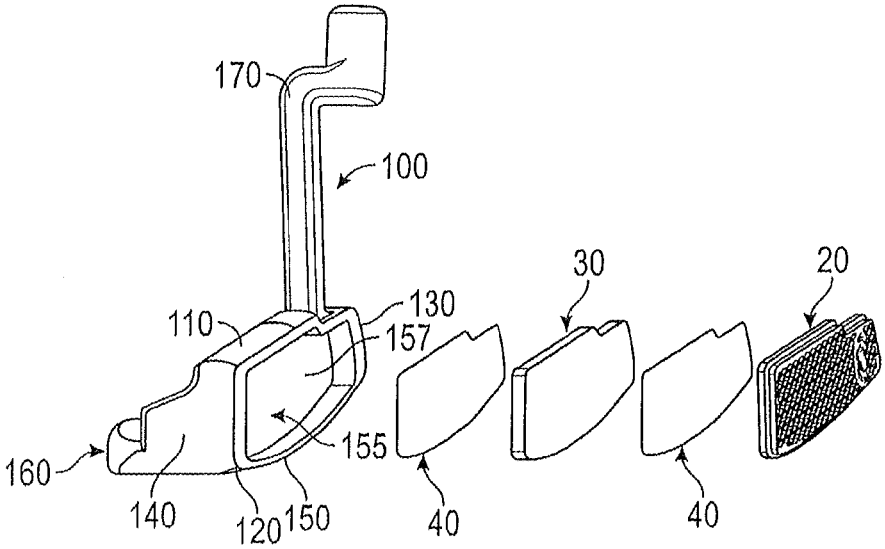
FIG. 5 is an exploded perspective view of the embodiment shown in FIG. 1 in combination with an exemplary golf club head.

FIG. 5 shows an exemplary putter head 100 into which the face insert 10 of the present invention can be inserted. The putter head 100 includes a top surface, a bottom surface 120, a heel side 130, a toe side 140, a face portion 150 including a recess 155, a rear portion 160, and a hosel 170. The metal sheet 20 is bonded to the backing 30 with an adhesive 40 that is evenly applied over a back surface of the metal sheet 20, and then the backing 30 is bonded to a bottom surface 157 of the recess 155 with an adhesive 40.

The particular dimensions and materials disclosed herein with respect to the first embodiment of the present invention provide a golf club containing this face insert 10 with more control over the golf ball's spin than prior art clubs. Testing was performed using the putter head 100 shown in FIG. 5, which includes the preferred embodiment of the present invention, and two commercially available putter products. A golfer hit five putts with each putter and the results of these hits were measured and analyzed. As shown in Table 1 below, though Commercial Product 1 produced more top spin, it also launched the ball at an undesirably high angle, which caused the ball to bounce. While Commercial Product 2 launched the golf ball at a lower angle than Commercial Product 1, it created an undesirably low spin rate. The putter head including the preferred embodiment of the present invention produced more top spin that Commercial Product 2 and a launched the golf ball at a much lower angle than both Commercial Products, causing less bounce than both of these clubs and a more constant deceleration of the golf ball during its skid phase. This, in turn, produced a smoother and more consistent roll in both appearance and distance control.

TABLE 1

| Golf Club | Ball Speed | Launch Angle | Spin Rate |
|---|---|---|---|
| Preferred embodiment | 5.62 mph | 2.34° | 48.73 rpm |
| Commercial Product 1 | 5.47 mph | 4.20° | 86.76 rpm |
| Commercial Product 2 | 5.85 mph | 3.16° | 33.83 rpm |

Figure 6:
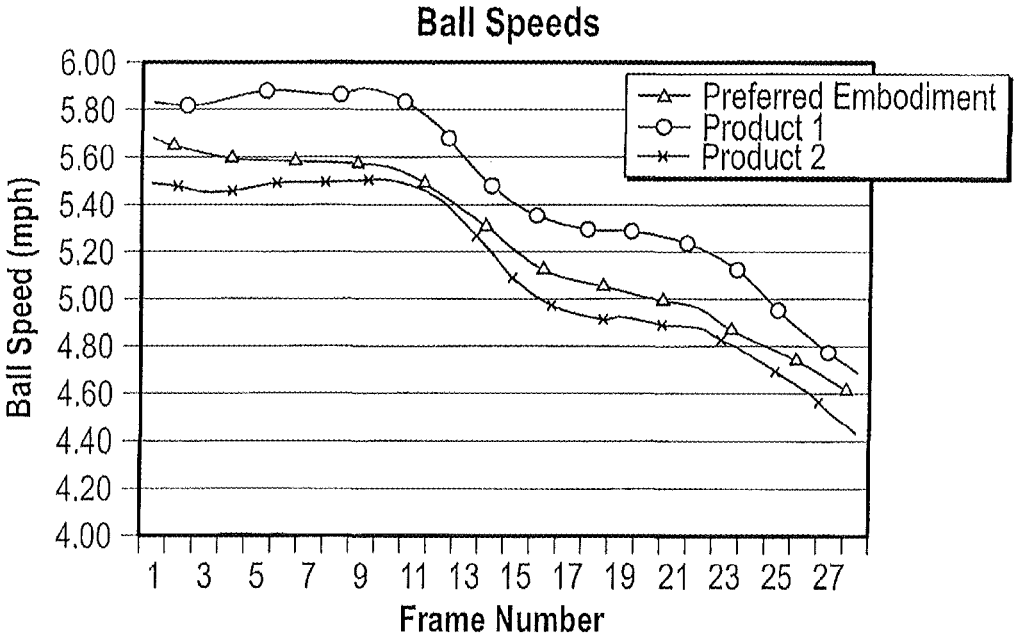
FIG. 6 is a graph comparing ball speeds imparted by the embodiment shown in FIG. 5 with ball speeds imparted by other commercial putters.

The deceleration of golf balls hit by each golf club in Table 1 was also analyzed, as shown in FIG. 6. The speed deceleration of a golf ball struck by the putter head 100 shown in FIG. 5 was more constant, and resulted in a flatter line in the plotted graph of FIG. 6 than the other two putters. This due to the combination of a lower launch angle with the right amount of top spin, which minimized bouncing and produced more consistent deceleration and thus a smoother, more consistent roll.

In another test, the spin of golf balls hit at different head speeds, which are representative of different putting distances, was measured using a putter including a face having the preferred embodiment of the present invention and a putter having a smooth face. Launch angles were also measured for each club and each head speed. As shown in Table 2, the preferred embodiment of the invention causes golf balls to launch at lower angles and with more top spin than the traditional, smooth-faced putter, thus providing a golfer with more control over the ball.

TABLE 2

| Golf Club Face | Measurement | 4.5 mph (3.5 foot putt) | 6 mph (8 foot putt) | 7.5 mph (20 foot putt) |
|---|---|---|---|---|
| Smooth | Spin (rpm) | 8.76 | 0.27 | −7.12 |
| | Launch (deg) | 3.27 | 3.19 | 2.91 |
| | Ball Speed (mph) | 4.48 | 5.589 | 7.78 |
| Preferred Embodiment | Spin (rpm) | 16.52 | 10.00 | 11.08 |
| | Launch (deg) | 3.26 | 2.74 | 2.26 |
| | Ball Speed (mph) | 4.39 | 5.83 | 7.64 |

Figure 7:
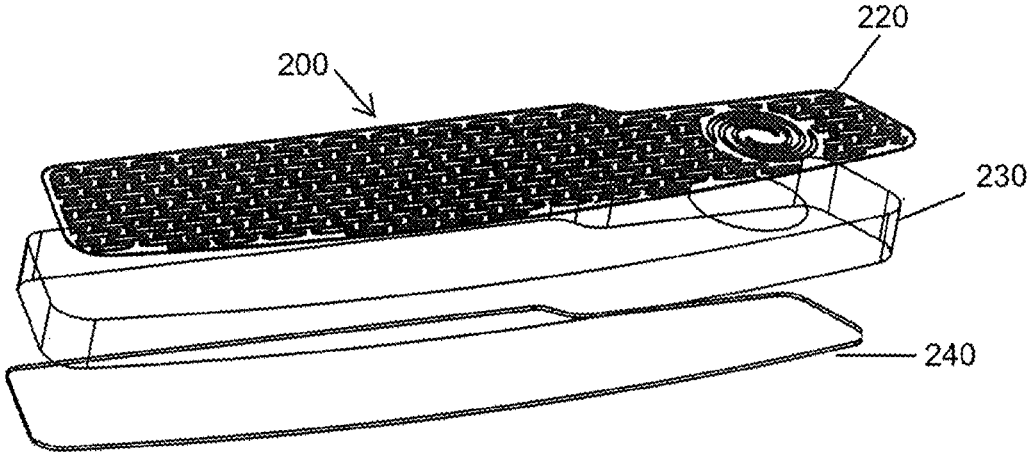
FIG. 7 is an exploded, perspective view of a second embodiment of the present invention.
Figure 8:
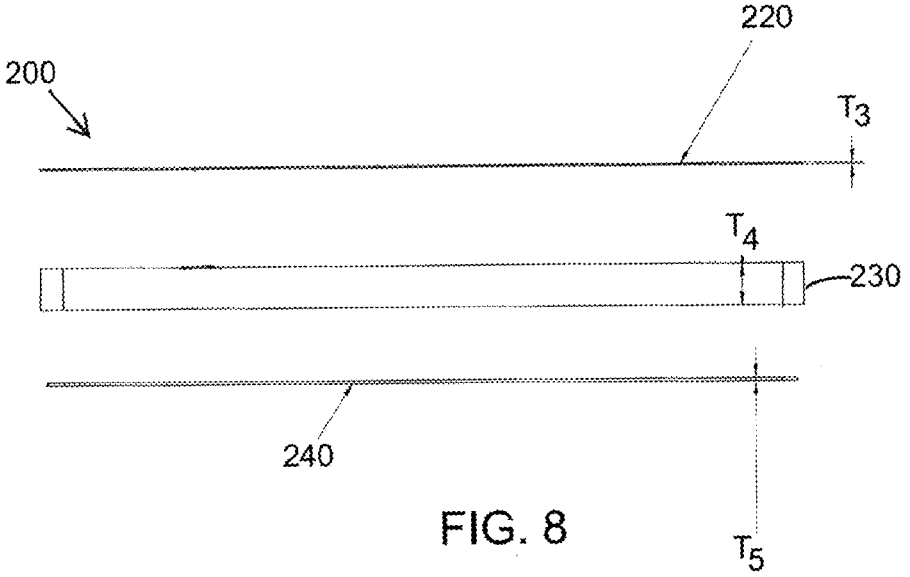
FIG. 8 is a side, plan view of the embodiment shown in FIG. 7.

Another embodiment of the present invention is shown in FIGS. 7-8. In this embodiment, a striking sheet 220 with a thickness $T_3$ of 0.005 to 0.020 inch, and more preferably 0.007 to 0.016, inch is permanently affixed to a urethane backing 230 with a thickness $T_4$ of approximately 0.200±0.050 inch using adhesive, preferably 3M 7533 adhesive that is applied to one or both of the striking sheet 220 and urethane backing 230 via silk screening. The striking sheet 220 includes the textured surface 22 pattern disclosed herein, with oval-shaped holes 24 having the dimensions and spacing disclosed herein. In this preferred embodiment, however, the oval-shaped holes 24 extend completely through the thickness $T_3$ of the striking sheet 220, giving the striking sheet 220 a mesh-like structure. Another adhesive layer 240 with a thickness $T_5$ of approximately 0.015±0.010 inch is then affixed to the back of the urethane backing 230, and the resulting face insert 200 is inserted into a recess in a golf club head 100 as shown in FIG. 5. This embodiment combines the feel of a urethane face with the improved gripping technology of a striking sheet 220 with an improved, textured surface 22, the benefits of which are demonstrated in Tables 1 and 2 and FIG. 6 herein.

In some embodiments disclosed herein, the striking sheet 220 is composed of a metal material, which may be aluminum, steel, titanium, nickel titanium, or another lightweight, high strength material, and more preferably is composed of aluminum. In alternative embodiments, however, the striking sheet 220 may be composed of a high strength, non-metal material, such as plastic, urethane, or composite. Similarly, in the preferred embodiment, the urethane backing 230 is composed of a urethane having a hardness of Shore 42D, but in other embodiments the hardness of the urethane backing 230 may range from 40D to 60D, including hardnesses of Shore 50D-55D.

In yet another embodiment, the oval patterns described herein are formed within a solid metal face of a putter using any means known to a person skilled in the art, including, but not limited to, chemical etching, electroforming, machining, and stamping. These methods may also be used to form the textured surface of any of the embodiments disclosed herein.

Figure 9:
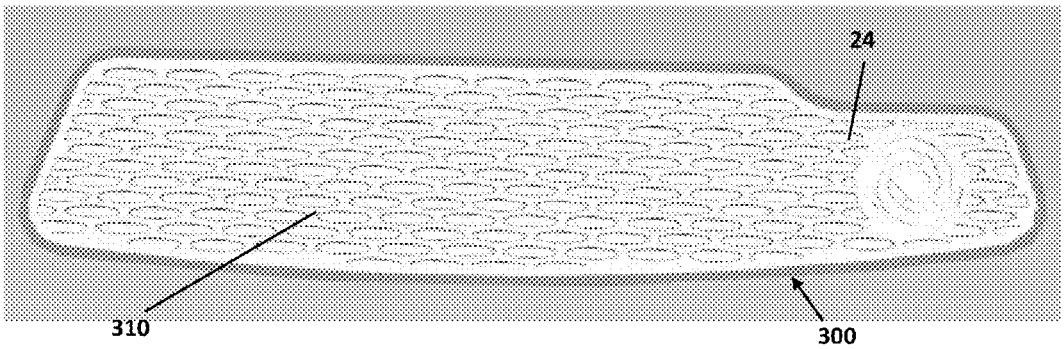
FIG. 9 is a front, plan view of a preferred embodiment of the present invention.

In a preferred embodiment, shown in FIG. 9, the pattern of oval-shaped holes 24 described herein is disposed in a one-piece putter face insert 300 composed of at least one thermoplastic polyether ester elastomer (TPEE) that incorporates polytetramethylene ether (PTMEG) soft segments with molecular weights of greater than 1000 g/mol, and preferably at least 1400 g/mol. Higher molecular weight PTMEG increases the overall degree of solid state phase separation in TPEE materials, and this increases rebound resilience when the face insert contacts a golf ball. Arnitel® EL250 and EM400 are some commercially available examples of this material, which is very resilient, is easy to injection mold, and is cheaper than more exotic polyurethane formulations. The pattern of oval-shaped holes 24 preferably is co-molded into the face insert 300 during injection molding, but in other embodiments it may be stamped, etched, machined, or otherwise created in the striking surface 310 of the face insert 300 through any means known to a person skilled in the art.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club face insert comprising:
- a front surface;
- a back surface; and
- a plurality of oval-shaped holes extending into the front surface,
- wherein each of the plurality of oval-shaped holes has a width of 0.150 inch to 0.200 inch and a height of 0.020 to 0.060 inch, and
- wherein the face insert is composed of at least one thermoplastic polyether ester elastomer.

2. The golf club face insert of claim 1, wherein the width is approximately 0.180 inch, and wherein the height is approximately 0.040 inch.

3. The golf club face insert of claim 1, wherein each of the plurality of oval-shaped holes is spaced horizontally from neighboring oval-shaped holes by 0.01 to 0.03 inch, and wherein each of the plurality of oval-shaped holes is spaced vertically from neighboring oval-shaped holes by 0.005 to 0.011 inch.

4. The golf club face insert of claim 3, wherein each of the plurality of oval-shaped holes is spaced horizontally from neighboring oval-shaped holes by approximately 0.026 inch, and wherein each of the plurality of holes is spaced vertically from neighboring oval-shaped holes by approximately 0.009 inch.

5. The golf club face insert of claim 1, wherein the face insert has a thickness of no less than 0.100 inch and no more than 0.300 inch.

6. The golf club face insert of claim 1, wherein at least one of the plurality of oval-shaped holes extends completely through the face insert.

7. The golf club face insert of claim 1, wherein the at least one thermoplastic polyether ester elastomer incorporates polytetramethylene ether soft segments with a molecular weight of greater than 1000 g/mol.

8. A golf club head comprising:
- a body comprising a top surface, a bottom surface, a heel side, a toe side, and a face recess; and
- a face insert composed of a comprising a plurality of oval-shaped holes,
- wherein each of the plurality of oval-shaped holes has a width of 0.150 inch to 0.200 inch and a height of 0.020 to 0.060 inch,
- wherein the face insert is composed of at least one thermoplastic polyether ester elastomer,
- wherein the face insert is sized to fit within the face recess, and
- wherein the face insert is secured within the face recess.

9. The golf club head of claim 8, wherein the golf club head is selected from the group consisting of a fairway head, driver head, hybrid head, iron head, and putter head.

10. The golf club head of claim 9, wherein the golf club head is a putter head.

11. The golf club head of claim 8, wherein each of the plurality of oval-shaped holes is spaced horizontally from neighboring oval-shaped holes by 0.01 to 0.03 inch, and wherein each of the plurality of oval-shaped holes is spaced vertically from neighboring oval-shaped holes by 0.005 to 0.011 inch.

12. The golf club head of claim 11, wherein each of the plurality of oval-shaped holes is spaced horizontally from neighboring oval-shaped holes by approximately 0.026 inch, and wherein each of the plurality of holes is spaced vertically from neighboring oval-shaped holes by approximately 0.009 inch.

13. The golf club head of claim 8, wherein the at least one thermoplastic polyether ester elastomer incorporates polytetramethylene ether soft segments with a molecular weight of greater than 1000 g/mol.

14. A putter head comprising:

a body comprising a top surface, a bottom surface, a heel side, a toe side, and a face recess; and a face insert composed of at least one thermoplastic polyether ester elastomer, wherein the at least one thermoplastic polyether ester elastomer incorporates polytetramethylene ether soft segments with a molecular weight of greater than 1000 g/mol, wherein the face insert comprises a plurality of oval-shaped holes, wherein each of the plurality of oval-shaped holes is spaced horizontally from neighboring oval-shaped holes by 0.01 to 0.03 inch, wherein each of the plurality of oval-shaped holes is spaced vertically from neighboring oval-shaped holes by 0.005 to 0.011 inch, and wherein the face insert is disposed within the face recess.

15. The putter head of claim 14, wherein the face insert is permanently fixed within the face recess.

16. The putter head of claim 14, wherein at least one of the plurality of oval-shaped holes extends completely through the face insert.

17. The putter head of claim 14, wherein the face insert has a thickness of no less than 0.100 inch and no more than 0.300 inch.

18. The putter head of claim 14, wherein the polytetramethylene ether soft segments have a molecular weight of at least 1400 g/mol.

* * * * *